US008443490B2

(12) United States Patent
Forrest et al.

(10) Patent No.: US 8,443,490 B2
(45) Date of Patent: May 21, 2013

(54) UNIVERSAL REVERSIBLE GATE HINGES AND METHOD OF ASSEMBLY

(75) Inventors: Earl David Forrest, Asheboro, NC (US); Andrew J. Graff, Greensboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 1192 days.

(21) Appl. No.: 11/758,246

(22) Filed: Jun. 5, 2007

(65) Prior Publication Data

US 2008/0301905 A1 Dec. 11, 2008

(51) Int. Cl.
*E05D 5/02* (2006.01)

(52) U.S. Cl.
USPC ..... 16/387

(58) Field of Classification Search
USPC ..... 16/387, 251, 365, 382, 388, 389, 16/390, 391, 392, 86.1, 86.2
See application file for complete search history.

(56) References Cited

U.S. PATENT DOCUMENTS

| | | | | | |
|---|---|---|---|---|---|
| 84,771 | A | | 12/1868 | Shannon | |
| 179,470 | A | | 7/1876 | Buffington | |
| 568,316 | A | | 9/1896 | Lawrence | |
| 739,088 | A | * | 9/1903 | Krisner | 16/387 |
| 1,167,444 | A | * | 1/1916 | Stevenson | 16/251 |
| 2,648,870 | A | | 8/1953 | Wilhelmi | |
| 2,837,760 | A | * | 6/1958 | Ware | 16/274 |
| 3,015,126 | A | | 1/1962 | Ahlgren | |
| 3,216,054 | A | | 11/1965 | Cain | |
| 3,263,368 | A | | 8/1966 | Hildum | |
| 3,921,225 | A | | 11/1975 | Suska | |
| 4,353,146 | A | | 10/1982 | Brockhaus | |
| 4,381,580 | A | * | 5/1983 | Hellstrom et al. | 16/243 |
| 4,573,239 | A | * | 3/1986 | Valenti et al. | 16/273 |
| 4,756,055 | A | | 7/1988 | Welsch | |
| 4,854,009 | A | | 8/1989 | Brockhaus | |
| 4,873,744 | A | | 10/1989 | Johnson | |
| 4,932,693 | A | | 6/1990 | Schwartz | |
| 5,075,928 | A | | 12/1991 | Bobrowski | |
| 5,463,795 | A | | 11/1995 | Carlson | |
| 6,163,929 | A | | 12/2000 | Bradley | |
| 6,173,475 | B1 | | 1/2001 | Senn | |
| 6,804,862 | B2 | | 10/2004 | Miller | |
| 6,836,933 | B2 | | 1/2005 | Janczak | |
| 2002/0060460 | A1 | * | 5/2002 | DeSouza | 292/238 |

* cited by examiner

*Primary Examiner* — Victor Batson
*Assistant Examiner* — Matthew Sullivan
(74) *Attorney, Agent, or Firm* — Carlson, Gaskey & Olds P.C.

(57) ABSTRACT

A family of reversible hinges includes a strap hinge, a tee-hinge and a screw hook hinge. Each of the strap hinge, tee-hinge and screw hinge includes a universal strap leaf, a secondary strap leaf, a removable hinge pin and at least one bearing. The universal strap leaf is interchangeable between each of the strap hinge, the tee-hinge and the screw hook hinge, creating commonality amongst the family of reversible hinges, thereby reducing tooling costs and inventory levels associated with the family of reversible hinges. Further, the at least one bearing is manufactured from an acetal material to reduce hinge noise and prevent rust-lock.

9 Claims, 6 Drawing Sheets

UNIVERSAL REVERSIBLE GATE HINGES AND METHOD OF ASSEMBLY

BACKGROUND OF THE INVENTION

This application relates to a family of reversible gate hinges, wherein each hinge includes a group of universal components interchangeable between each individual reversible gate hinge.

As is known, each gate hinge type within a gate hinge product line typically contains many different components, for example, a long strap leaf, a short strap leaf and a hinge pin. The long strap leaf and short strap leaf are attached to one another via the hinge pin to form a gate hinge. However, there is typically little to no commonality between the individual components of one gate hinge to another gate hinge within the gate hinge product line. Instead, the components associated with each individual gate hinge vary with each individual application or purpose. This requires making and maintaining different tooling for each individual component, which can be expensive.

Further, known gate hinge components are typically manufactured from metal, for example steel. As such, during the life of the gate hinge, there is continuous metal to metal contact of the hinge pin and the hinge. This can result in a noisy gate hinge that, over time, may develop a rust-lock condition, where moisture and worn finishes allow the gate hinge components to fuse together over time and non-use.

As such, it is desirable to provide a product line of reversible gate hinges that include a maximum number of common components across the product line. It is further desirable that the product line of gate hinges includes bearings that eliminate metal to metal contact thereby reducing noise levels during operation and prevent the tendency of the metal components fusing together over time and from non-use.

SUMMARY OF THE INVENTION

In a disclosed example embodiment of the present invention, a family of reversible hinges includes a strap hinge, a tee-hinge and a screw hook hinge. Each of the strap hinge, tee-hinge and screw hinge includes a universal strap leaf, a secondary strap leaf, a removable hinge pin and at least one bearing. The universal strap leaf is interchangeable between each of the strap hinge, the tee-hinge and the screw hook hinge, creating commonality amongst the family of reversible hinges, thereby reducing tooling costs and inventory levels associated with the family of reversible hinges. Further, the at least one bearing is manufactured from an acetal material to reduce hinge noise and prevent rust-lock.

The family of reversible hinges is created by selecting a universal strap leaf from a group of universal strap leaves in which each of the universal strap leaves within the group of universal strap leaves are interchangeable with one another. A secondary strap is selected from a group of secondary straps and assembled to the selected universal strap leaf to create a first gate hinge. Subsequently, another universal strap leaf is selected from the group of universal strap leaves and another secondary strap is selected from the group of secondary straps and assembled to the universal strap leaf to create a second gate hinge that is different from the first gate hinge.

Each of the universal straps within the group of universal straps is interchangeable with one another. While the group of secondary straps includes a variety of different secondary straps, for example, a short strap, a tee-hinge strap and a screw hook strap.

Each of the universal straps is hingeably attached its respective secondary strap via a removable hinge pin. Further, at least one bearing is installed into each side of the universal strap prior to insertion of the removable hinge pin.

These and other features of the present invention can be best understood from the following specification and drawings, the following of which is a brief description.

DETAILED DESCRIPTION OF THE PREFERRED EMBODIMENT

Figure 1:
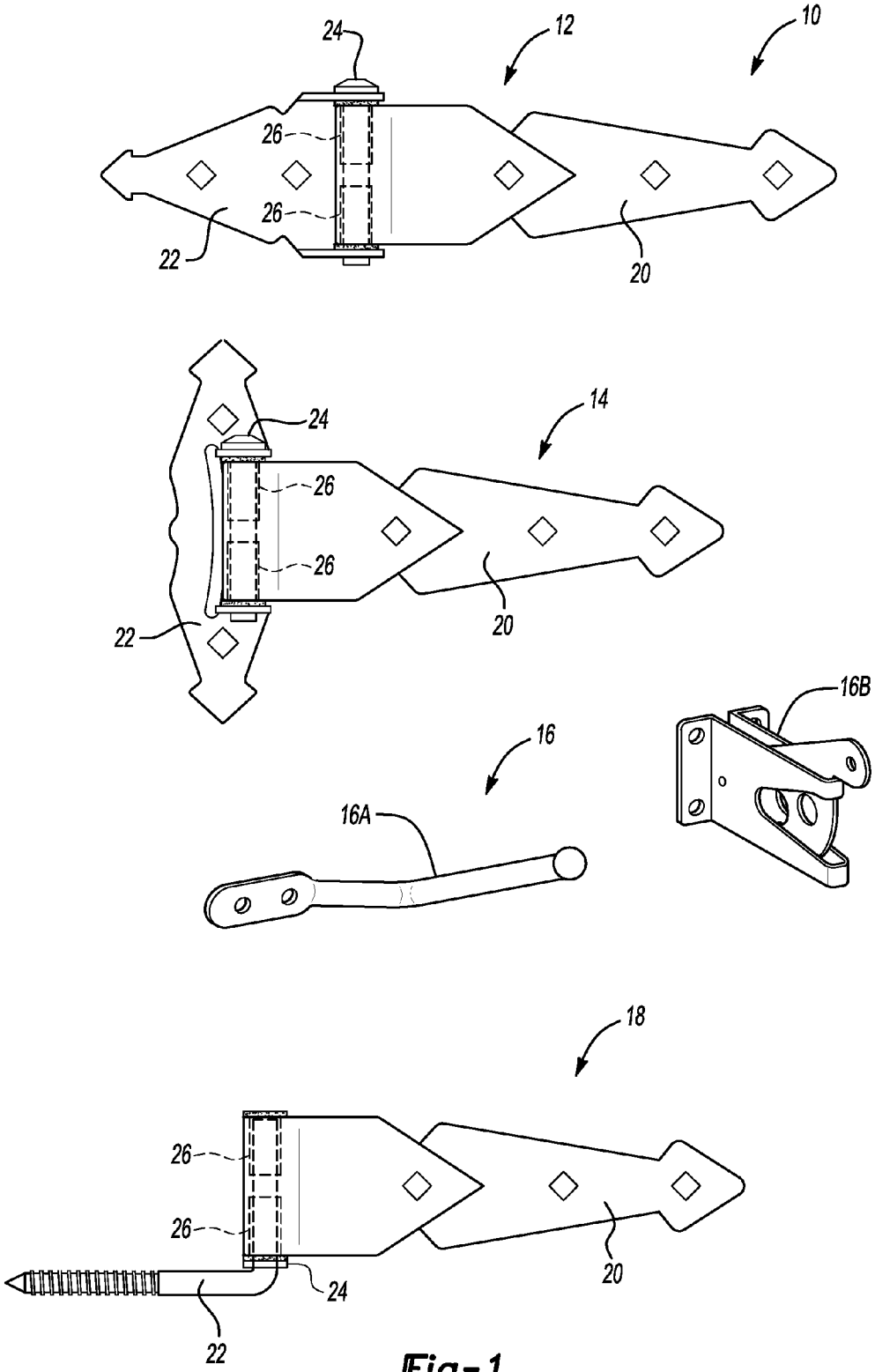
FIG. 1 shows an example family of reversible hinges according to one embodiment of the present invention.

An example family of reversible hinges 10 according to one embodiment of the present invention is shown in FIG. 1. The example family of reversible hinges 10 includes a strap hinge 12, a tee-hinge 14 that includes an optional latch mechanism 16, and a screw hook hinge 18. Each of the strap hinge 12, the tee-hinge 14 and the screw hook hinge 18 includes a universal strap leaf 20, a secondary strap 22 and a removable hinge pin 24, all of which are typically manufactured from a metal, for example steel.

Figure 2:
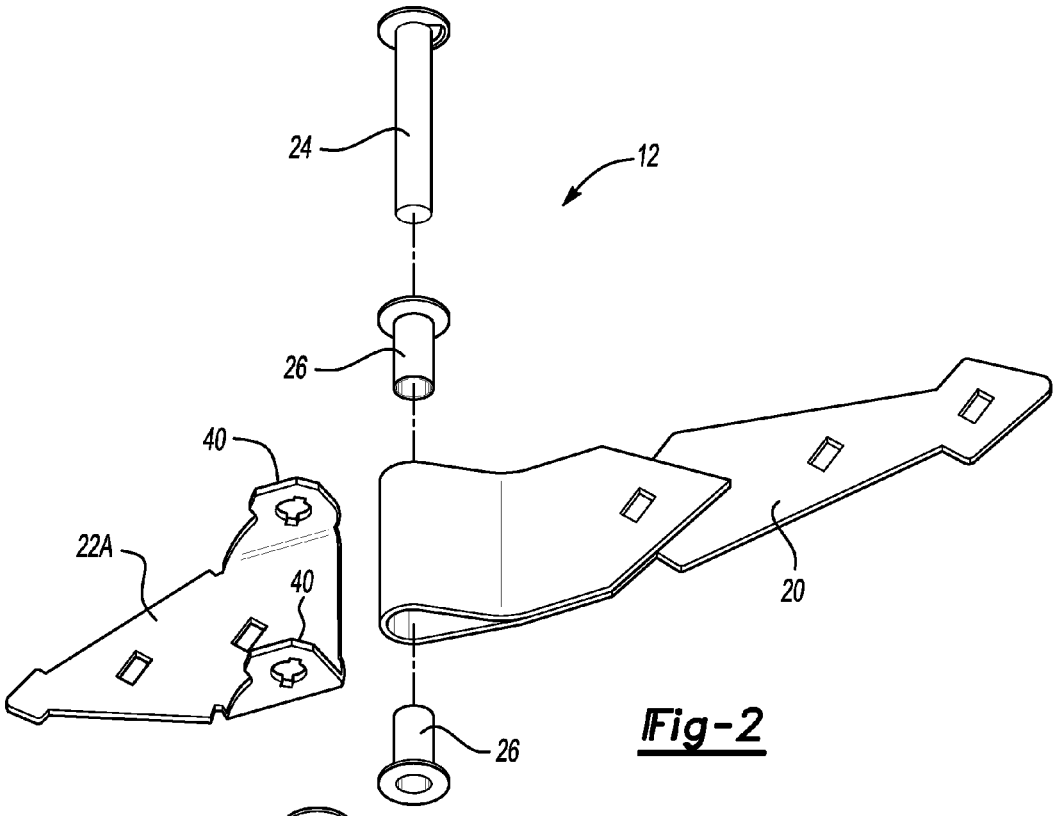
FIG. 2 shows an exploded view of a first example reversible hinge from the example family of reversible hinges shown in FIG. 1.

An exploded view of the example strap hinge 12 is shown as FIG. 2. The strap hinge 12 includes the universal strap leaf 20 and a short strap version 22A of the secondary strap 22. The short strap 22A includes a pair of hinge flaps 40. The short strap 22A is hingeably attached to the universal strap leaf 20 within the pair of hinge flaps via the removable hinge pin 24. Non-metallic bearings 26 are inserted into both sides of universal strap leaf 20 prior to assembly of the universal strap leaf 20 to the short strap 22A and prior to insertion of the removable hinge pin 24.

Figure 3:
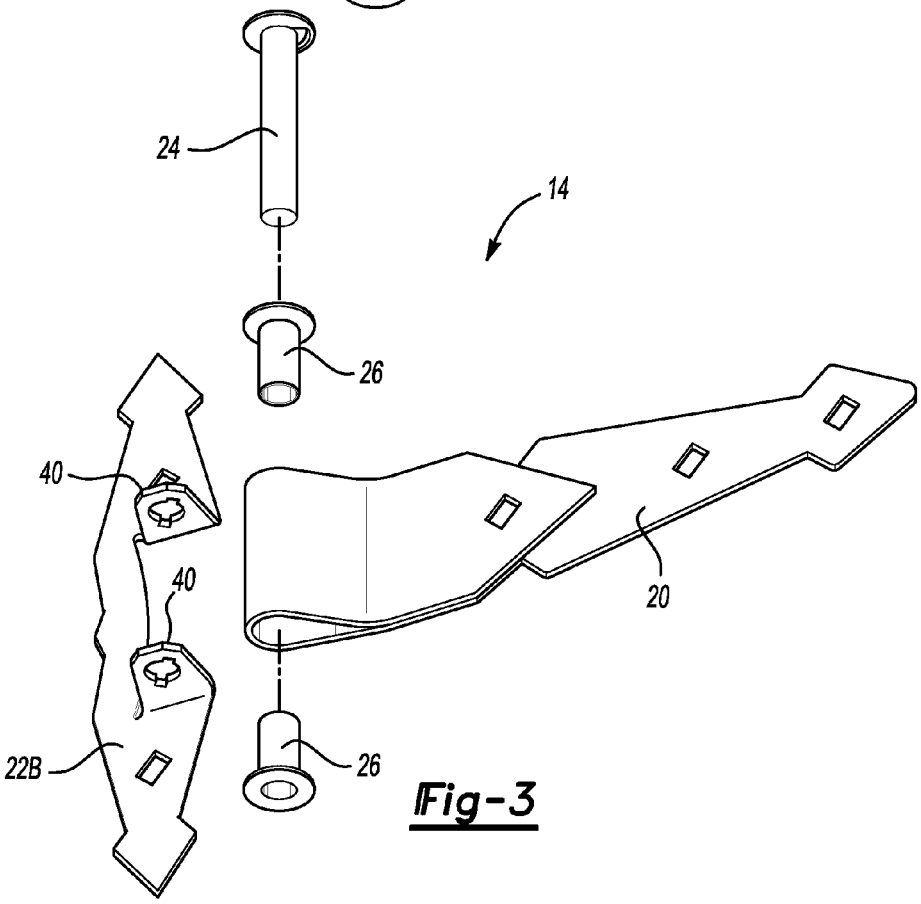
FIG. 3 shows an exploded view of a second example reversible hinge from the example family of reversible hinges shown in FIG. 1.

An exploded view of the example tee-hinge 14 is shown as FIG. 3. The tee-hinge hinge 14 includes the universal strap leaf 20 and a tee-hinge strap version 22B of the secondary strap 22. The tee-hinge strap 22B includes the pair of hinge flaps 40. The tee-hinge strap 22B is hingeably attached to the universal strap leaf 20 within the pair of hinge flaps 40 via the removable hinge pin 24. Non-metallic bearings 26 are inserted into both sides of the universal strap leaf 20 prior to assembly of the universal strap leaf 20 to of the tee-hinge strap 22B and prior to insertion of the removable hinge pin 24.

Figure 4:
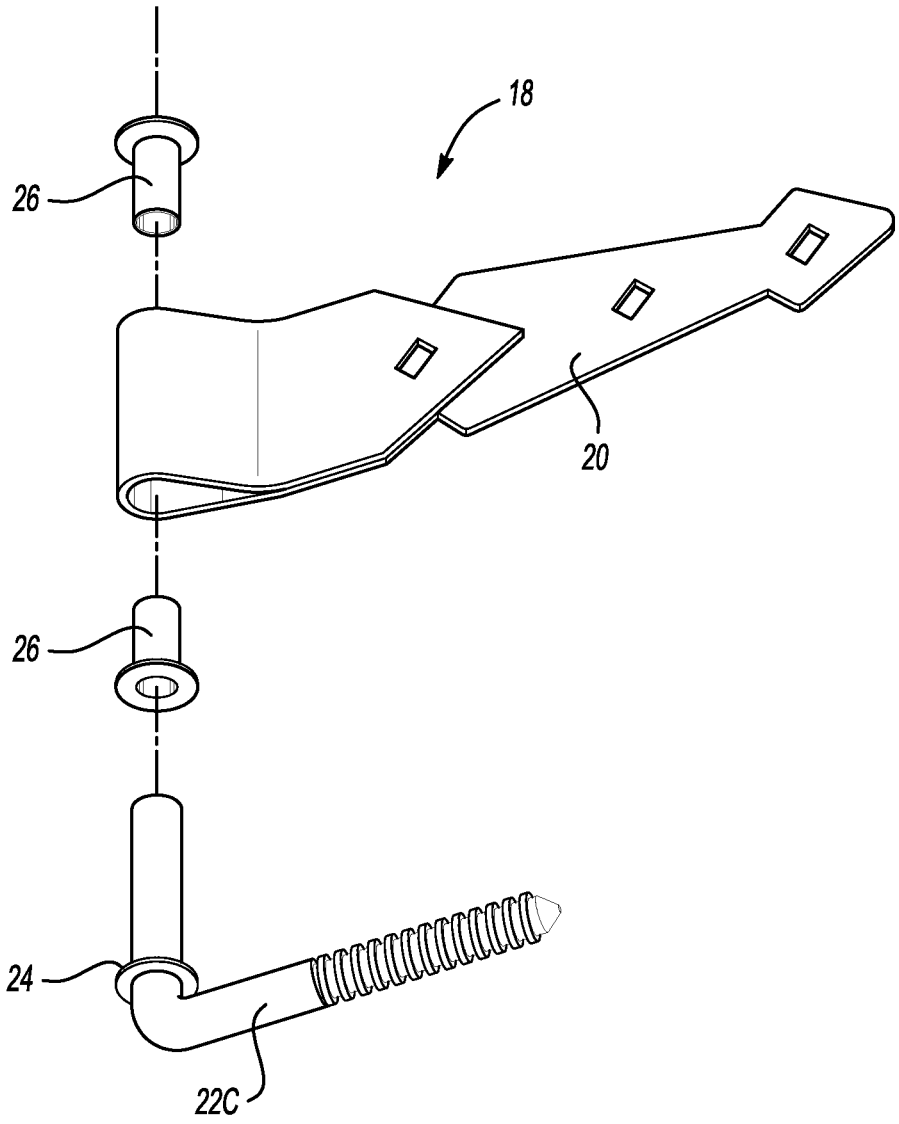
FIG. 4 shows an exploded view of a third example reversible hinge from the example family of reversible hinges shown in FIG. 1.

An exploded view of the example screw hook hinge 18 is shown as FIG. 4. The screw hook hinge 18 includes the universal strap leaf 20 and a screw hook strap version 22C of the secondary strap 22. The screw hook strap 22C is integrally formed with the removable hinge pin 24 and hingeably attached to the universal strap leaf 20 as an assembly 22C, 24.

Non-metallic bearings 26 are inserted into both sides of the universal strap leaf 20 prior to insertion of the assembly 22C, 24.

The universal strap leaf 20 is interchangeable between each of the strap hinge 12, tee-hinge 14 and the screw hook hinge 18 resulting in reduced tooling costs and inventory levels. In addition, the non-metallic bearings 26 may be manufactured from an acetal material, for example, Delrin manufactured by DuPont. The bearing prevents moisture from forming rust that can result in a noisy hinge and which may ultimately result in a rust-lock condition in which the metal components of the hinge fuse together over time and non-use.

Figure 5A:
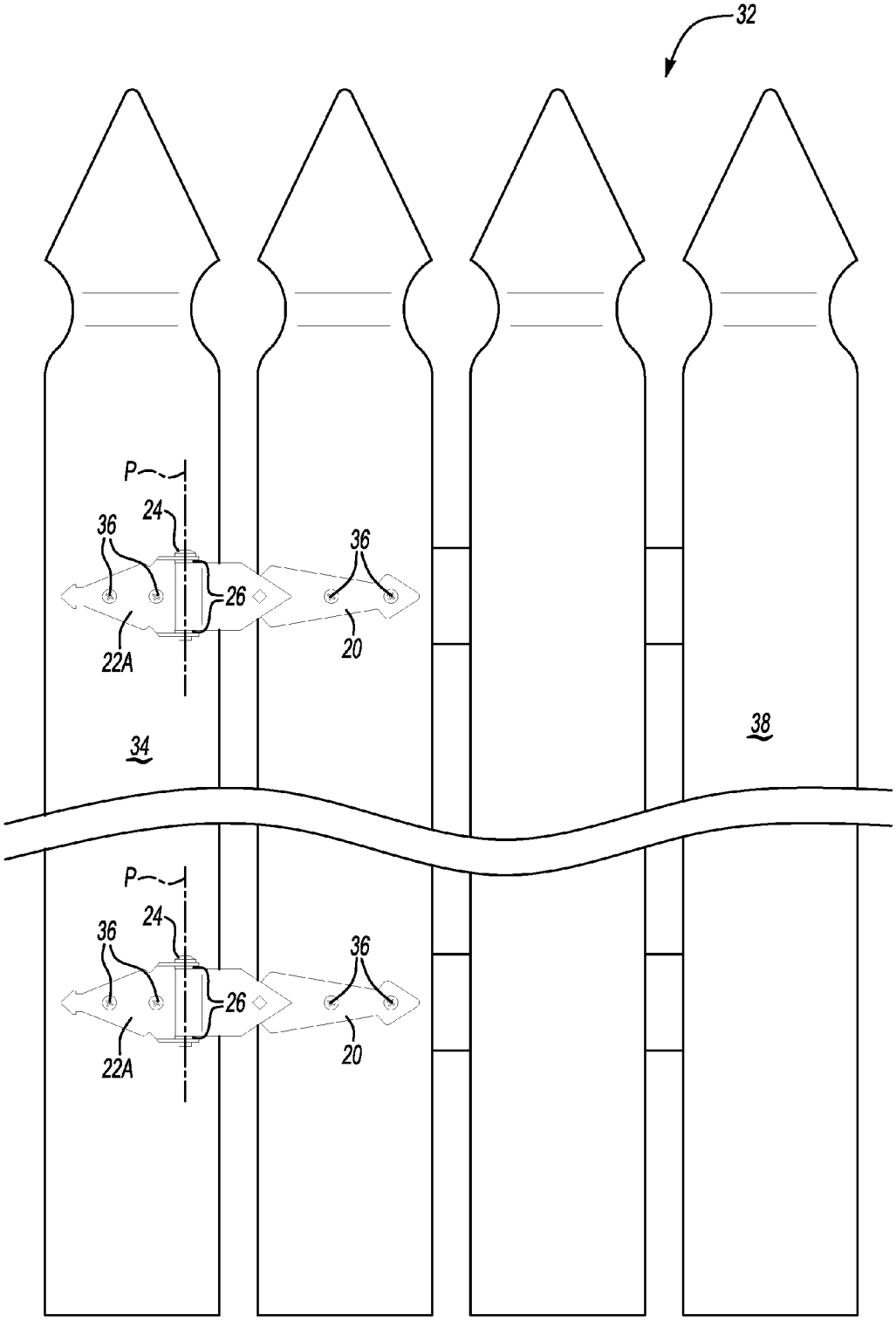
FIG. 5A shows the first example reversible hinge of FIG. 2 assembled to a gate.
Figure 5B:
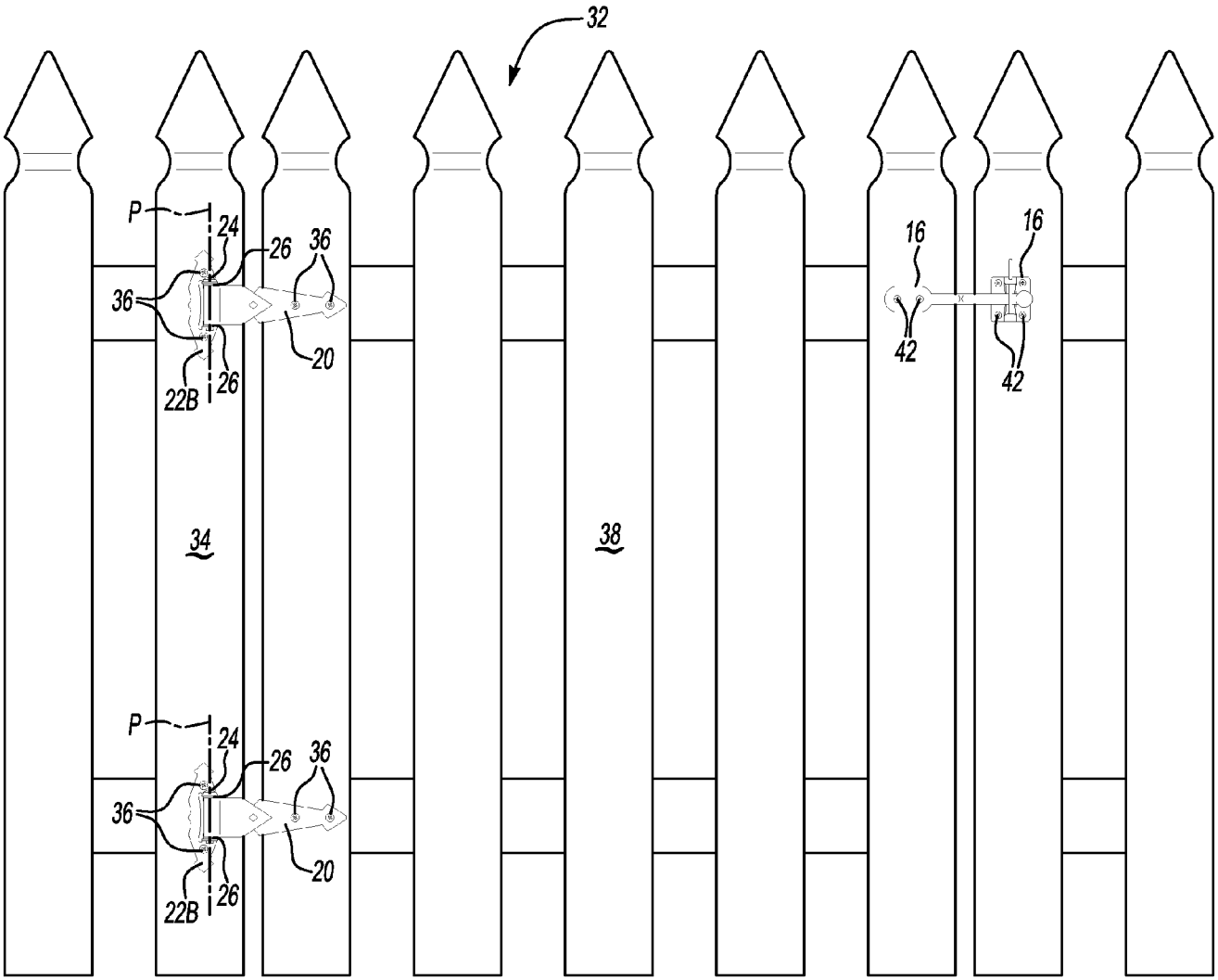
FIG. 5B shows the second example reversible hinge of FIG. 3 assembled to a gate.
Figure 5C:
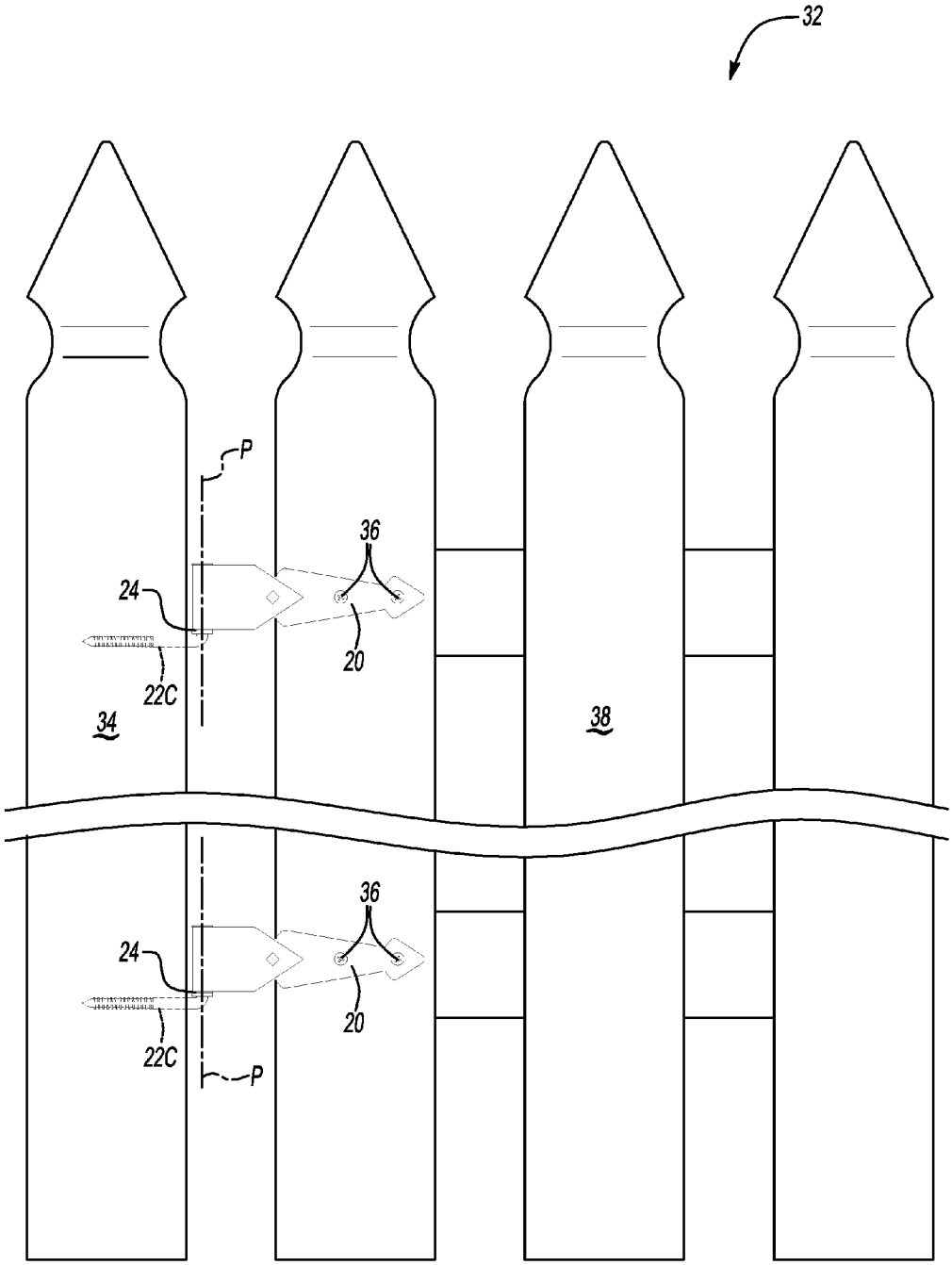
FIG. 5C shows the third example reversible hinge of FIG. 4 assembled to a gate.

FIGS. 5A, 5B and 5C show each of the family of reversible hinges 10 assembled to a door and frame assembly 32, for example a gate.

FIG. 5A shows the strap hinge 12 assembled to the gate 32. The short strap 22A is attached to a door jamb 34 via fasteners 36. The universal strap leaf 20 is attached to a door 38 via fasteners 36. A hinge end of the universal strap leaf 20 is positioned within the pair of hinge flaps 40 (FIG. 2). A bearing 26 is inserted into both sides of the universal strap leaf 20 and the removable hinge pin 24 is inserted into the bearings 26. During use, the door 38 pivots about an axis P defined by the removable hinge pins 24.

FIG. 5B shows the tee-hinge 14 assembled to the gate 38. The tee-hinge strap 22B is attached to the door jamb 34 via fasteners 36. The universal strap leaf 20 is attached to the door 38 via fasteners 36. The hinge end of the universal strap leaf 20 is positioned within the pair of hinge flaps 40 (FIG. 3). Bearings 26 are inserted into both sides of the universal strap leaf 20 and the removable hinge pin 24 is inserted into the bearings 26. During use, the door 38 pivots about the axis P defined by the removable hinge pins 24.

The optional latch mechanism 16 includes a tongue portion 16A and a latching portion 16B. The tongue portion is attached to the door 38 via fasteners 42. The latching portion 16B is attached to the door jamb 34 via fasteners 42. During use, the latching portion 16B receives the tongue portion 16A to secure the door 38 in a closed position, as is commonly known.

FIG. 5C shows the screw hook hinge 18 assembled to the gate 32. The screw hook strap 22C is threaded into to the door jamb 34. The universal strap leaf 20 is attached to the door 38 via fasteners 36. Bearings 26 are inserted into each side of the universal strap leaf 20 and the removable hinge pin 24 is inserted into the bearings 26. During use, the door 38 pivots within the door frame 34 about axis P defined by the removable hinge pins 24.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A family of reversible gate hinges comprising:
a first gate hinge;
at least a second gate hinge, wherein each of the first gate hinge and the second gate hinge include:
a universal strap leaf;
a secondary strap;
at least one bearing in engagement with the universal strap leaf;
a removable hinge pin in engagement with the at least one bearing to hingeably attach the secondary strap to the universal strap leaf, wherein the universal strap leaf is interchangeable between the first gate hinge and the second gate hinge and wherein the secondary strap of the first gate hinge is different than the secondary strap of the secondary gate hinge;
the universal strap leaf of the first gate hinge is identical to the universal strap leaf of the second gate hinge; and
the secondary strap of the first hinge is a tee hinge leaf and the secondary strap of the second gate hinge is a short strap leaf.

2. The family of reversible gate hinges as recited in claim 1, further including a third gate hinge, wherein a secondary strap of the third gate hinge is different from the secondary strap of the first gate hinge and the secondary strap of the second gate hinge.

3. The family of reversible gate hinges as recited in claim 2, wherein the secondary strap of the third gate hinge is integral with the removable hinge pin.

4. The family of reversible gate hinges as recited in claim 3, further including two bearings.

5. The family of reversible gate hinges as recited in claim 4, wherein the two bearings are non-metallic.

6. A family of reversible gate hinges comprising:
a first gate hinge;
a second gate hinge;
a third gate hinge, wherein each of the first gate hinge, the second gate hinge, and the third gate hinge include:
a universal strap leaf;
a secondary strap;
at least one bearing in engagement with the universal strap leaf; and
a removable hinge pin in engagement with the at least one bearing to hingeably attach the secondary strap to the universal strap leaf, wherein the secondary strap of the first gate hinge is a short strap, the secondary strap of the second gate hinge is a tee-hinge strap, and the secondary strap of the third gate hinge is a screw hook strap.

7. A method of assembling a family of reversible gate hinges comprising the steps of:
a) selecting a universal strap leaf;
b) selecting a secondary strap from a group of secondary straps having a variety of configurations;
c) assembling the universal strap leaf selected in step a) to the secondary strap selected in step b) to create a first gate hinge;
d) selecting another universal strap leaf;
e) selecting another secondary strap from the group of secondary straps; and
f) assembling the universal strap leaf selected in step d) to the secondary strap selected in step e) to create a second gate hinge, different from the first gate hinge; wherein the group of secondary straps includes a short strap, a tee-hinge strap and a screw hook strap; and further including the step of inserting a removable hinge pin into each of the universal strap leaf/secondary strap assemblies assembled in step c), step f) and step i) to hingeably attach each of the universal strap leaves their respective secondary straps.

8. The method of assembling a family of reversible gate hinges as recited in claim 7, further including the step of inserting at least one bearing into each of the universal strap leaves prior to insertion of the removable hinge pin.

9. The method of assembling a family of reversible gate hinges as recited in claim 7, wherein the group of secondary straps includes a short strap, a tee-hinge strap and a screw hook strap.

* * * * *

UNITED STATES PATENT AND TRADEMARK OFFICE

CERTIFICATE OF CORRECTION

PATENT NO. : 8,443,490 B2
APPLICATION NO. : 11/758246
DATED : May 21, 2013
INVENTOR(S) : Forrest et al.

It is certified that error appears in the above-identified patent and that said Letters Patent is hereby corrected as shown below:

IN THE CLAIMS:

Claim 7, Column 4, line 55: delete “,”

Claim 7, Column 4, line 55: insert --and-- between “step c)” and “step f)”

Claim 7, Column 4, line 55: delete “and step i)”

Signed and Sealed this
Third Day of September, 2013

Teresa Stanek Rea
*Acting Director of the United States Patent and Trademark Office*